US005435745A

United States Patent [19]

Booth

[11] Patent Number: 5,435,745

[45] Date of Patent: Jul. 25, 1995

[54] CONNECTOR FOR COAXIAL CABLE HAVING CORRUGATED OUTER CONDUCTOR

[75] Inventor: Kevin G. Booth, Chicago, Ill.

[73] Assignee: Andrew Corporation, Orland Park, Ill.

[21] Appl. No.: 251,571

[22] Filed: May 31, 1994

[51] Int. Cl.[6] ..... H01R 17/04

[52] U.S. Cl. ..... 439/584; 439/583

[58] Field of Search ..... 439/578–585, 439/675

[56] References Cited

U.S. PATENT DOCUMENTS

| | | | |
|---|---|---|---|
| 3,199,061 | 8/1965 | Johnson et al. | 439/583 |
| 4,046,451 | 9/1977 | Juds et al. | 439/583 |
| 5,167,533 | 12/1992 | Rauwolf | 439/583 |
| 5,322,454 | 6/1994 | Wommen | 439/584 |
| 5,354,217 | 10/1994 | Gabel et al. | 439/583 |

*Primary Examiner*—David L. Pirlot
*Attorney, Agent, or Firm*—Arnold, White & Durkee

[57] ABSTRACT

A connector assembly for a coaxial cable with an inner conductor and a corrugated outer conductor. The connector assembly comprises an inner contact adapted to engage the end of the inner conductor of the coaxial cable, a body member in the form of a hollow cylinder with a threaded inside surface at one end, and an attachment nut in the form of a hollow cylinder with a threaded outside surface for threadingly engaging the threaded inside surface of the body member, and a threaded inside surface for threadingly engaging the corrugated outer conductor of the cable. The attachment nut also forms a barrel projecting longitudinally from one end of the threaded outer surface and along the corrugated outer conductor. The barrel has a non-circular inside surface with a minimum inside dimension at least as large as the maximum outside diameter of the outer conductor of the cable. A bushing engages the outer surface of the barrel and deforms the barrel into the outer conductor of the cable in response to telescoping advancement of the body member onto the attachment nut.

15 Claims, 4 Drawing Sheets

CONNECTOR FOR COAXIAL CABLE HAVING CORRUGATED OUTER CONDUCTOR

FIELD OF THE INVENTION

The present invention relates generally to connectors for coaxial cables, and, more particularly, to an improved connector for coaxial cables having corrugated outer conductors.

BACKGROUND OF THE INVENTION

Connectors for coaxial cable having corrugated conductors are generally used throughout the coaxial cable industry. For example, Rauwolf U.S. Pat. No. 5,167,533 describes a connector for coaxial cables having corrugated outer conductors and hollow inner conductors. Vaccaro et al. U.S. Pat. No. 5,154,636 describes a self-flaring connector for coaxial cables having helically corrugated outer conductors. Doles U.S. Pat. No. 5,137,470 describes a connector for coaxial cables having helically corrugated inner conductors. Juds et at. U.S. Pat. No. 4,046,451 describes a connector for coaxial cables having angularly corrugated outer conductors and plain cylindrical inner conductors. Van Dyke U.S. Pat. No. 3,291,895 describes a connector for cables having helically corrugated inner and outer conductors. A connector for a coaxial cable having a helically corrugated outer conductor and a plain cylindrical inner conductor is described in Johnson et at. U.S. Pat. No. 3,199,061.

Pending Devine et al. U.S. patent application Ser. No. 08/078,621, assigned to the assignee of the present invention, describes a connector which can be manually crimped into the corrugated outer conductor of a coaxial cable.

SUMMARY OF THE INVENTION

It is a primary object of the invention to provide a self-crimping connector for a coaxial cable having a corrugated outer conductor, so that the connector can be installed more easily and quickly than previous connectors. A related object is to provide such an improved connector that ensures the crimping of the connector onto the outer conductor of the cable is both reliable and repeatable.

A further object of the present invention is to provide such an improved coaxial cable connector that locks the connector permanently on the cable, and that cannot be removed without gross distortion of the metal outer conductor.

Still another object of this invention is to provide an improved coaxial cable connector that provides good electrical contact between the connector and the cable over a long operating life.

Other objects and advantages of the invention will be apparent from the following detailed description and the accompanying drawings.

In accordance with the present invention, the foregoing objectives are realized by providing a connector assembly that includes an inner contact adapted to engage the inner conductor of the coaxial cable; a body member in the form of a hollow cylinder having a threaded inside surface at one end; and an attachment nut in the form of a hollow cylinder having a threaded outside surface for threadingly engaging the body member, and a threaded inside surface for threadingly engaging the corrugated outer conductor of the cable. The attachment nut also forms a barrel projecting longitudinally from the threaded portion and extending along the corrugated outer conductor. The barrel has a non-circular, preferably polygonal, inside surface with a minimum inside dimension at least as large as the maximum outside diameter of the outer conductor of the cable, and a plurality of longitudinal slots preferably divide the barrel into a plurality of fingers that can be deformed inwardly into the outer conductor. A bushing engages the outside surface of the barrel and deforms the barrel into the outer conductor of the cable in response to telescoping advancement of the body member onto the attachment nut.

Figure 1:
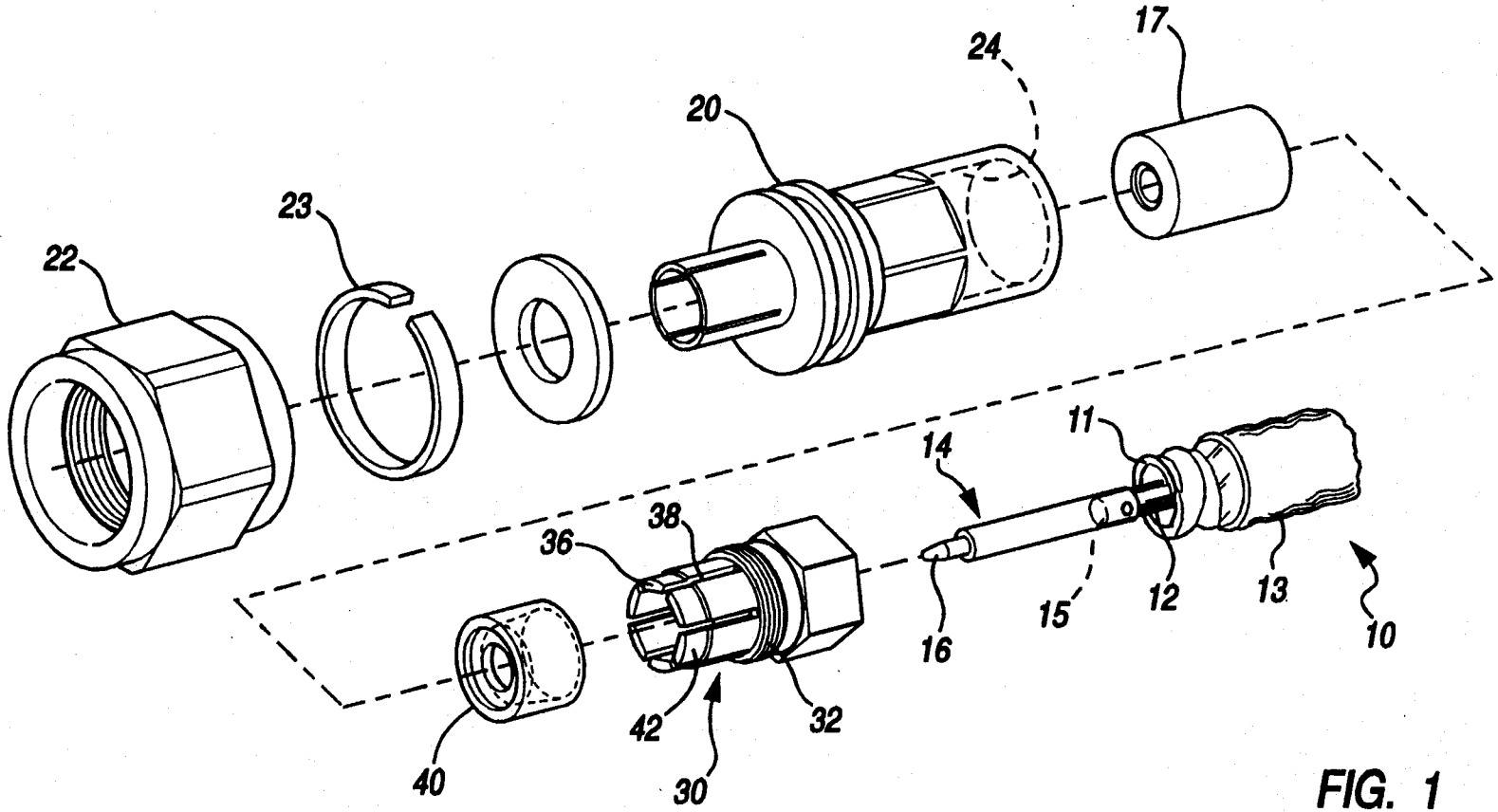
FIG. 1 is an exploded perspective view of a connector assembly embodying the present invention.
Figure 2:
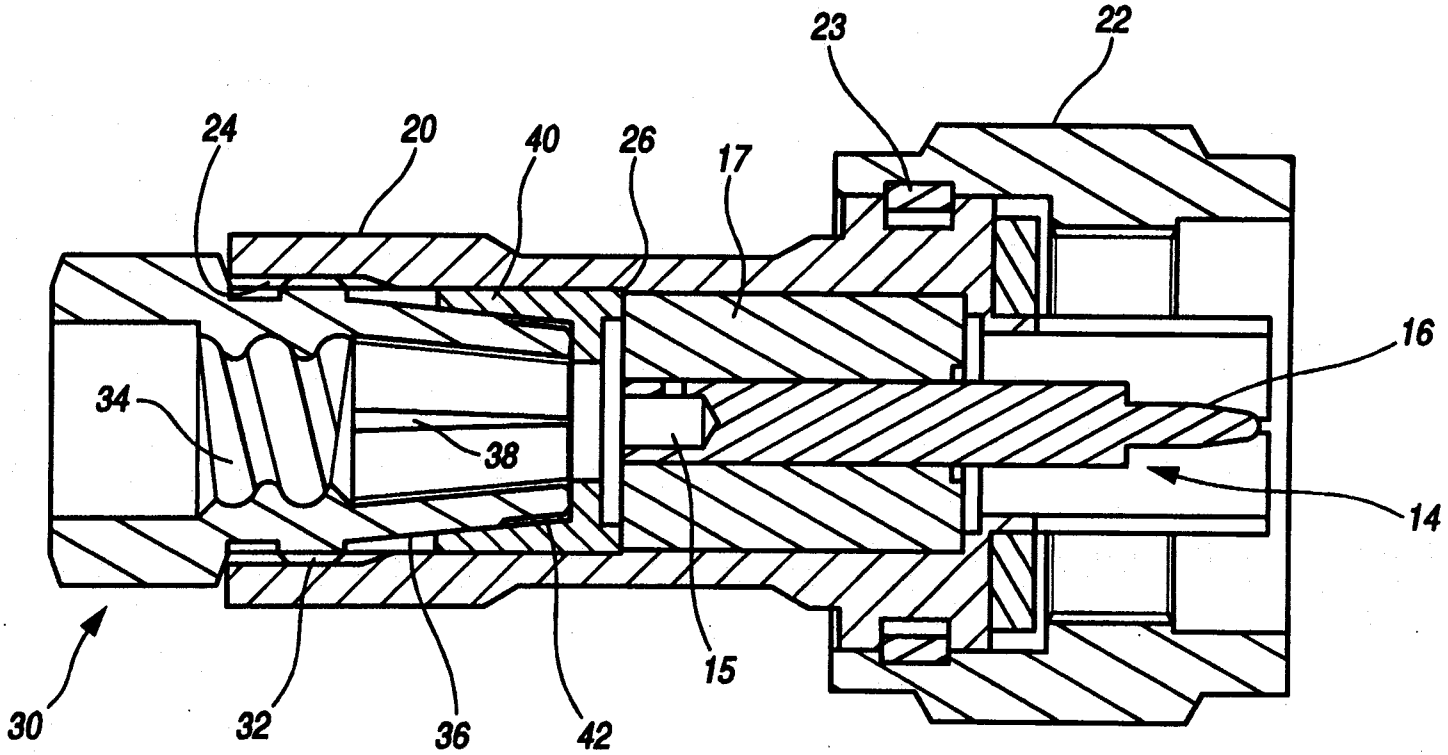
FIG. 2 is a longitudinal-section taken through the center of the connector assembly of FIG. 1 in its assembled condition.
Figure 3A:
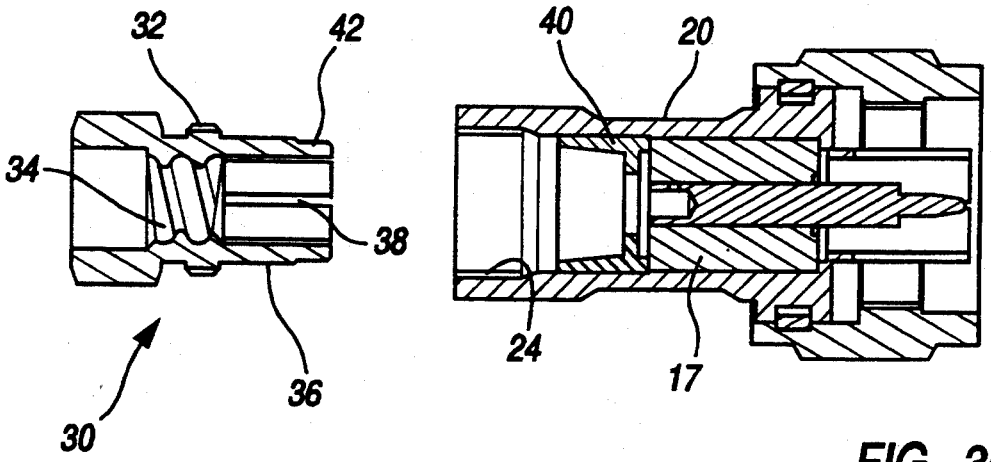
Figure 3B:
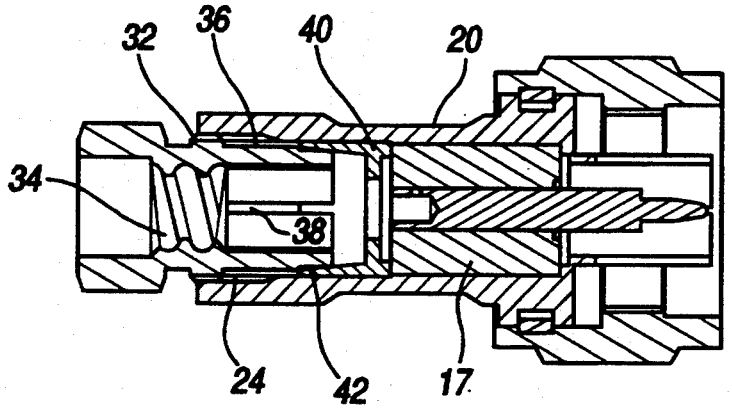
Figure 3C:
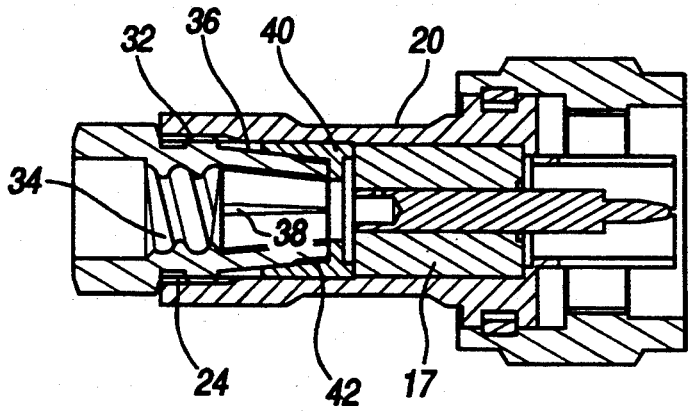
Figure 5:
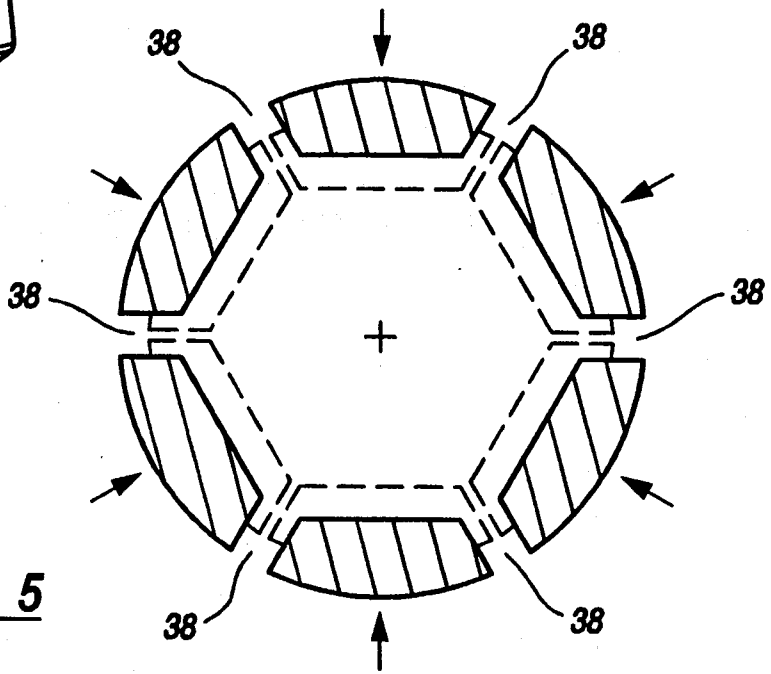
Figure 4:
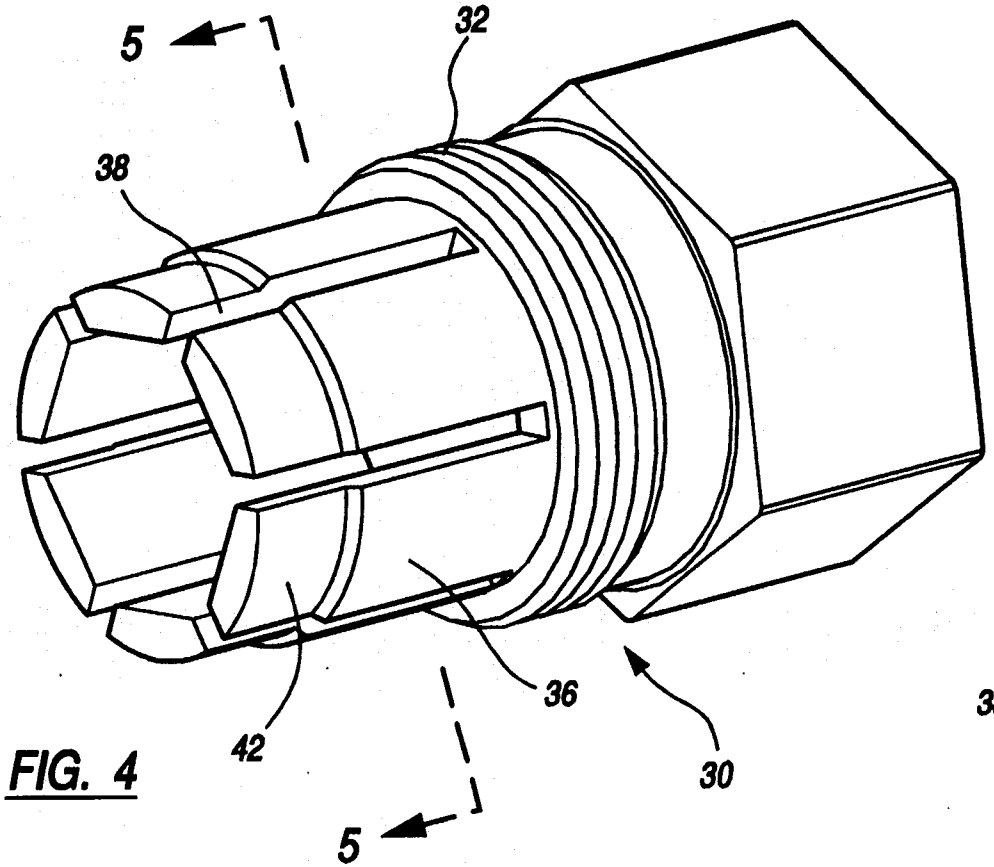

FIGS. *3a*, *3b* and *3c* are longitudinal sections similar to FIG. 2 and showing the connector assembly being sequentially assembled;

FIG. 4 is an enlarged perspective view of the attachment nut included in the connector assembly of FIGS. 1–3; and FIG. 5 is an enlarged section taken along line 5—5 in FIG. 4, and showing the crimped condition of the nut in broken lines.

DETAILED DESCRIPTION OF THE PREFERRED EMBODIMENT

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings, there is shown a connector assembly for a coaxial cable 10 having a helically corrugated outer conductor 11 concentrically spaced from a solid, smooth-walled inner conductor 12 by a dielectric spacer (not shown). As is well known to those familiar with this art, a helically corrugated conductor is distinguished from an annularly corrugated conductor in that the helical corrugations form a continuous pattern of corrugation crests and roots along the length of the cable such that each crest is opposite a root along the circumference of the conductor. Consequently, any transverse cross-section taken through the conductor perpendicular to its axis is radially asymmetrical, which is not true of annularly corrugated conductors.

To prepare the cable 10 for attachment of the connector assembly, the ends of the inner and outer conductors of the cable are cut along two different planes extending perpendicular to the axis of the cable. The first cutting plane is for the outer conductor 11 and the dielectric of the cable. The inner conductor 12 is cut in a plane spaced axially from the cutting plane for the outer conductor 11 so that the inner conductor extends beyond the cut end of the outer conductor. Any burrs or rough edges on the cut ends of the metal conductors 11 and 12 are preferably removed to avoid interference with the connector. The outer surface of the outer conductor 11 is normally covered with a plastic jacket 13 which is trimmed away from the end of the outer conductor 11 along a sufficient length to accommodate the connector assembly.

Electrical contact with the inner conductor 12 of the cable 10 is effected by a conventional inner contact 14, which is attached at its hollow base 15 to the cut end of the inner conductor 12. In the preferred embodiment, the inner contact 14 is secured to the inner conductor 12 by placing electrically conductive solder within the hollow base 15 and telescoping the base over the end of the inner conductor 12. An aperture may be provided in the side wall of the base 15 to permit overflow solder to escape. Alternatively, the base 15 of the inner contact may be attached to the conductor 12 by crimping or electrically conductive adhesive. The head 16 of the inner contact 14 forms a portion of a conventional male connector. To support the inner contact 14 concentrically within the connector assembly, a dielectric sleeve 17 is carried on the inner contact adjacent the base 15.

A stepped cylindrical body member 20 extends around the cut end of the coaxial cable 10. In the illustrated example, one end of the body member 20 supports a conventional coupling nut 22 secured to the body member 20 by a spring retaining ring 23 which holds the nut 22 captive on the body member 20 while permitting free rotation of the nut 22 on the member 20. The opposite end of the body member 20 has a threaded inside surface 24 for receiving an attachment nut 30 having a threaded outside surface 32. A portion of the inside surface of the nut 30 is threaded as at 34 to match the helical corrugations of the outer conductor 11. Thus, the attachment nut 30 can be easily applied by hand by threading it onto the outer conductor 11 until the body member 20 engages the enlarged head portion of the nut 30 (FIG. 2), which positions the inner end of the connector 30 flush with the cut end of the outer conductor 11.

The portion of the attachment nut 30 which extends longitudinally from the threaded surfaces 32 and 34 toward the cut end of the cable forms a barrel 36 whose outside surface is radially spaced from the inside surface of the body member 20. In the illustrated example, this barrel 36 has a hexagonal inside surface with a minimum inside dimension (distance between opposed flats of the hexagon) approximately equal to, or slightly greater than, the maximum outside diameter of the outer conductor 11 of the cable 10. A plurality of equally spaced longitudinal slots 38 divide the barrel 36 into a plurality of equally sized fingers that can be deformed inwardly into the outer conductor 11. In the illustrative embodiment, six slots 38 are located at the six corners of the hexagon.

For the purpose of deforming the barrel 36 of the attachment nut 30 into the outer conductor 11, a hollow cylindrical bushing 40 is located in the annular space between the opposed surfaces of the barrel 36 and the body member 20. The inside surface of this bushing 40 is tapered so that as the bushing is telescoped over the barrel 36, the inside surface of the bushing cams the fingers of the barrel 36 inwardly into the outer conductor 11. When the connector is first assembled, the bushing 40 overlaps only the end portion 42 of the barrel 36, which has a reduced outside diameter to facilitate the entry of the barrel 36 into the bushing 40 (FIGS. 3*a* and 3*b*). Then as the body member 20 and the attachment nut 30 are threaded together, a shoulder 26 on the inside surface of the body member 20 forces the bushing 40 farther onto the barrel 36. As the tapered inner surface of the bushing 40 is advanced onto and along the larger-diameter portion of the barrel 36, the bushing 40 gradually presses the fingers of the barrel inwardly into the crests of the corrugated outer conductor 11 (FIG. 3*c*). These radial compressive forces deform the engaged portions of the outer conductor 11 into the hexagonal configuration defined by the bore of the barrel 36, thereby locking the attachment nut 30 and the cable 10 together so that they cannot be rotated relative to each other. This advancing movement of the bushing 40 over the barrel 36 is limited by an inwardly extending flange near the end of the bushing 40, which ultimately abuts the free end of the barrel 36.

The crimping of the barrel 36 into the outer conductor 11 makes it virtually impossible to remove the connector manually, and even with the use of a tool, the connector cannot be removed without permanently damaging the portion of the cable to which the connector has been crimped. This permanent attachment of the connector to the cable ensures the maintenance of good electrical contact between the connector and the cable conductors, thereby ensuring a low VSWR throughout the operating life of the cable connection.

Instead of tapering the surface of the bushing 40 at the interface between the bushing 40 and the barrel 36, the taper can be formed on the surface of the barrel 36, or on both surfaces. Alternatively, the requisite taper may be formed on the inside surface of the body member 20, in which case the bushing 40 may even be formed as an integral part of the body member 20.

As in most connector assemblies, the shapes and dimensions of the various parts are selected to provide impedance matching between adjoining parts, so that the complete connector and cable assembly has a low VSWR.

I claim:

1. A connector assembly for a coaxial cable having an inner conductor and a corrugated outer conductor, said connector assembly comprising:

an inner contact adapted to engage the inner conductor of the coaxial cable, a body member in the form of a hollow cylinder having a threaded inside surface at one end, an attachment nut in the form of a hollow cylinder having a threaded outside surface for threadingly engaging said threaded inside surface of said body member, and a threaded inside surface for threadingly engaging the corrugated outer conductor of said cable, and forming a barrel projecting longitudinally from the threaded outer surface and extending along the corrugated outer conductor, said barrel having a non-circular inside surface with a minimum inside dimension at least as large as the maximum outside diameter of the outer conductor of the cable, and a bushing for engaging the outer surface of said barrel and deforming said barrel into the outer conductor of the cable in response to telescoping advancement of said body member onto said attachment nut.

2. The connector assembly of claim 1 wherein said barrel includes a plurality of longitudinal slots dividing said barrel into a plurality of fingers that can be deformed inwardly into the outer conductor.

3. The connector assembly of claim 1 wherein said bushing is a hollow cylindrical bushing shaped to fit between the outside surface of said barrel and the inside surface of said body member for forcing said barrel inwardly into the corrugated outer conductor of the cable as the bushing is advanced along the barrel, and including means for advancing said bushing over said barrel in response to the threading of said attachment nut into said body member.

4. The connector assembly of claim 1 wherein at least one of the engaging surfaces of said barrel and said bushing is tapered so that relative longitudinal movement of said bushing along said barrel applies compressive radial forces on the outside surface of said barrel.

5. The connector assembly of claim 1 wherein said bushing includes an inwardly extending flange for abutting the end of said barrel and thereby limiting the longitudinal movement of said bushing relative to said barrel.

6. The connector assembly of claim 1 which includes a dielectric spacer between said inner contact and said body member.

7. The connector assembly of claim 1 wherein said body member includes an internal shoulder so that the threading of said attachment nut into said body member causes said body member to force said bushing onto said barrel.

8. The connector assembly of claim 1 wherein an end portion of said barrel at the free end thereof has a reduced outside diameter to facilitate the entry of said barrel into said bushing.

9. In combination, a connector assembly and a coaxial cable having a helically corrugated outer conductor, the connector assembly comprising:

an inner contact adapted to engage the end of the inner conductor of the coaxial cable, a body member in the form of a hollow cylinder having a threaded inside surface at one end, an attachment nut in the form of a hollow cylinder having a threaded outside surface for threadingly engaging said threaded inside surface of said body member, and a threaded inside surface for threadingly engaging the corrugated outer conductor of said cable, and forming a barrel projecting longitudinally from the threaded outer surface and extending along the corrugated outer conductor, said barrel having a non-circular inside surface with a minimum inside dimension at least as large as the maximum outside diameter of the outer conductor of the cable, a bushing for engaging the outer surface of said barrel and deforming said barrel into the outer conductor of the cable in response to telescoping advancement of said body member onto said attachment nut, and a dielectric spacer between said inner contact and said body member.

10. The connector assembly of claim 9 wherein said barrel includes a plurality of longitudinal slots dividing said barrel into a plurality of fingers that can be deformed inwardly into the outer conductor.

11. The connector assembly of claim 9 wherein said bushing is a hollow cylindrical bushing shaped to fit between the outside surface of said barrel and the inside surface of said body member for forcing said barrel inwardly into the corrugated outer conductor of the cable as the bushing is advanced along the barrel, and including means for advancing said bushing over said barrel in response to the threading of said attachment nut into said body member.

12. The connector assembly of claim 9 wherein at least one of the engaging surfaces of said barrel and said bushing is tapered so that relative longitudinal movement of said bushing along said barrel applies compressive radial forces on the outside surface of said barrel.

13. The connector assembly of claim 9 wherein said bushing includes an inwardly extending flange for abutting the end of said barrel and thereby limiting the longitudinal movement of said bushing relative to said barrel.

14. The connector assembly of claim 9 wherein said body member includes an internal shoulder so that the threading of said attachment nut into said body member causes said body member to force said bushing onto said barrel.

15. The connector assembly of claim 9 wherein an end portion of said barrel at the free end thereof has a reduced outside diameter to facilitate the entry of said barrel into said bushing.

* * * * *